US009440200B2

(12) United States Patent
Frankel et al.

(10) Patent No.: US 9,440,200 B2
(45) Date of Patent: Sep. 13, 2016

(54) TUBE DIFFUSER

(71) Applicants: Thomas E. Frankel, Poughkeepsie, NY (US); Seoungil Kang, Poughkeepsie, NY (US); Todd D. Ritter, Poughkeepsie, NY (US)

(72) Inventors: Thomas E. Frankel, Poughkeepsie, NY (US); Seoungil Kang, Poughkeepsie, NY (US); Todd D. Ritter, Poughkeepsie, NY (US)

( * ) Notice: Subject to any disclaimer, the term of this patent is extended or adjusted under 35 U.S.C. 154(b) by 117 days.

(21) Appl. No.: 13/924,964

(22) Filed: Jun. 24, 2013

(65) Prior Publication Data

US 2014/0374928 A1 Dec. 25, 2014

(51) Int. Cl.
*B01F 3/00* (2006.01)
*B01F 3/04* (2006.01)

(52) U.S. Cl.
CPC .. *B01F 3/04269* (2013.01); *B01F 2003/04319* (2013.01)

(58) Field of Classification Search
CPC ..... B01F 3/04269; B01F 2003/04319; B01F 3/04255; B01F 3/04; F16B 7/0413–7/0426; F16B 7/0446–7/0473
USPC ..... 261/121.1, 122.1
See application file for complete search history.

(56) References Cited

U.S. PATENT DOCUMENTS

| | | | | |
|---|---|---|---|---|
| 3,822,075 | A * | 7/1974 | Duncan | F16L 23/04 285/367 |
| 5,059,358 | A | 10/1991 | Tharp | |
| 5,560,875 | A | 10/1996 | Meshengisser et al. | |
| 6,543,753 | B1 | 4/2003 | Tharp | |
| 6,626,425 | B2 | 9/2003 | Ott | |
| 7,044,453 | B2 | 5/2006 | Tharp | |
| 2007/0182036 | A1* | 8/2007 | Jager | B01F 3/04269 261/122.1 |
| 2007/0257382 | A1* | 11/2007 | Mitchell | A01K 63/042 261/100 |
| 2014/0264965 | A1* | 9/2014 | Jager | 261/64.1 |

FOREIGN PATENT DOCUMENTS

| | | | | |
|---|---|---|---|---|
| DE | 3319161 | A1 * | 11/1984 | B01F 3/04269 |
| DE | 3700038 | A1 | 7/1988 | |

OTHER PUBLICATIONS

European Search Report for EP 14 16 1956 (counterpart to present application), Sep. 30, 2014, the Hague.

* cited by examiner

*Primary Examiner* — Thomas Bennett McKenzie
(74) *Attorney, Agent, or Firm* — Law Offices of Michael L. Wise, LLC

(57) ABSTRACT

Aspects of the invention are directed to an apparatus comprising a proximal end adapter, a distal end adapter, a support tube, and a flexible diffuser membrane. The support tube is disposed between the proximal end adapter and the distal end adapter, and comprises an outward facing surface that defines a series of ridges thereon. The diffuser membrane, in turn, defines a plurality of perforations, and surrounds at least a respective portion of each of the proximal end adapter, the distal end adapter, and the support tube.

18 Claims, 7 Drawing Sheets

TUBE DIFFUSER

FIELD OF THE INVENTION

The present invention relates generally to aeration devices, and, more particularly, to tube diffusers for use in wastewater treatment applications and the like.

BACKGROUND OF THE INVENTION

Tube diffusers are conventionally used to support aerobic biological processes in wastewater treatment plants. A tube diffuser typically comprises a cylindrical flexible diffuser membrane that covers a rigid cylindrical support tube. Supplying pressurized air to the tube diffuser while the tube diffuser is immersed in wastewater has the effect of expanding the flexible diffuser membrane away from the support tube and causing the air to escape into the wastewater through a multiplicity of perforations in the flexible diffuser membrane. The effect is a plume of small bubbles that act both to oxygenate the biological processes occurring in the wastewater treatment tank and to provide a mixing function. Wastewater treatment in such a manner is described in, as just one example, F. L. Burton, *Wastewater Engineering* (McGraw-Hill College, 2002), which is hereby incorporated by reference herein.

Typically a flexible diffuser membrane is somewhat loose when applied to its underlying support tube. This looseness makes installation less difficult, improves the uniformity of the air distribution through the flexible diffuser membrane (particularly when air flow rates are low), and reduces the pressure drop associated with inflating and penetrating the diffuser membrane (i.e., head loss). However, this looseness also frequently negatively impacts the useful lifetime of a flexible diffuser membrane. A common failure mechanism for conventional flexible diffuser membranes is "flexure failures" or "destructive folding," wherein buoyancy, wastewater velocity, and/or debris combine with the relatively loose fit of the flexible diffuser membrane to cause the flexible diffuser membrane to fold on itself (i.e., pinch) when the supply of pressurized air is turned off. With frequent on/off cycling of the pressurized air, as is common in, for example, Sequencing Batch Reactors (SBRs), this repeated folding ultimately causes the flexible diffuser membrane to tear.

For the foregoing reasons, there is a need for methods and apparatus that provide a solution for flexure failures in tube diffusers without negatively impacting ease of installation, gas distribution uniformity, and head loss.

SUMMARY OF THE INVENTION

Embodiments of the present invention address the above-identified needs by providing tube diffuser designs that avoid flexure failures without negatively impacting ease of installation, gas distribution, and head loss.

Aspects of the invention are directed to an apparatus comprising a proximal end adapter, a distal end adapter, a support tube, and a flexible diffuser membrane. The support tube is disposed between the proximal end adapter and the distal end adapter, and comprises an outward facing surface that defines a series of ridges thereon. The diffuser membrane, in turn, defines a plurality of perforations, and surrounds at least a respective portion of each of the proximal end adapter, the distal end adapter, and the support tube.

An embodiment of the invention, for example, provides a tube diffuser having a support tube underlying a flexible diffuser membrane. The support tube comprises an outward facing surface that defines a series of evenly spaced ridges thereon that run longitudinally down the support tube about the entire circumference of the support tube. Advantageously, these ridges: 1) ease installation of the flexible diffuser membrane on the support tube by decreasing frictional contact between the flexible diffuser membrane and the support tube while the tube diffuser is in air; 2) create longitudinal channels between the flexible diffuser membrane and the support tube while the tube diffuser is immersed and receiving pressurized gas so as to improve gas distribution uniformity; 3) allow more uniform fouling of flexible diffuser membrane perforations when fouling does occur, also improving gas distribution uniformity; and 4) provide the flexible diffuser membrane with a greater surface area on to which to relax when the tube diffuser membrane is immersed and the pressurized gas supply is turned off, thereby reducing the chance of the flexible diffuser membrane folding on itself and tearing.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

Figure 1:
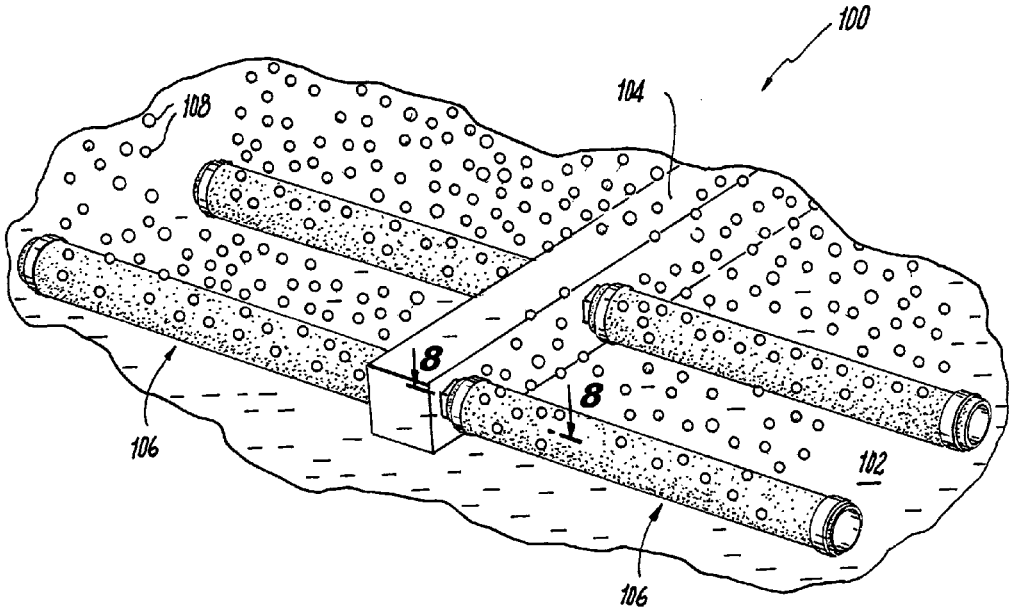
FIG. 1 shows a perspective view of a portion of a wastewater aeration system, in accordance with an illustrative embodiment of the invention.

FIG. 1 shows a perspective view of a portion of a wastewater aeration system 100 in accordance with an illustrative embodiment of the invention. For purposes of illustration, the wastewater aeration system 100 is shown as it might appear while operating in a wastewater treatment tank. More particularly, the wastewater aeration system 100 is immersed in wastewater 102. A square header pipe 104 supplies a pressurized gas (e.g., pressurized air) to four tube diffusers 106. The tube diffusers 106, in turn, emit the gas into the wastewater 102 in the form of small bubbles 108.

Figure 2:
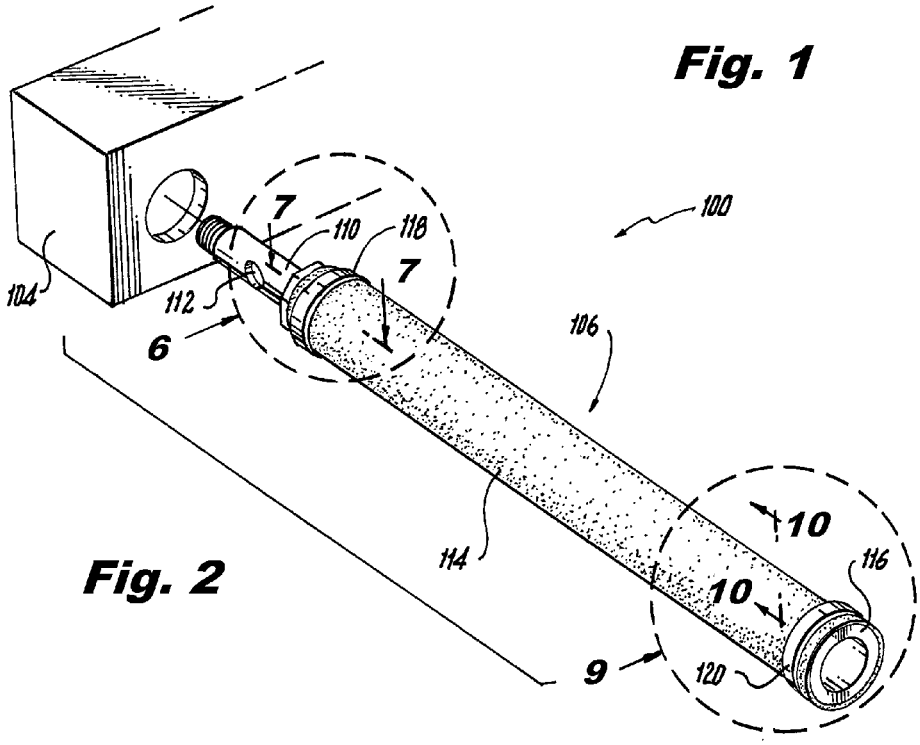
FIG. 2 shows an exploded perspective view of the header pipe and the tube diffuser in the FIG. 1 system.

FIG. 2 shows an exploded perspective view of the header pipe 104 and a representative one of the tube diffusers 106 from FIG. 1. In the present illustrative embodiment, the tube diffuser 106 is coupled to the square header pipe 104 utilizing a header pipe connector 110. The header pipe connector 110 is adapted so as to support two tube diffusers 106 on opposing sides of the square header pipe 104, as in FIG. 1. Two opposed openings 112 in the header pipe connector 110 (only one being visible in FIG. 2) allow pressurized gas from the header pipe 104 to be routed into the tube diffuser 106. The tube diffuser 106 itself comprises a cylindrical flexible diffuser membrane 114 that is supported by an underlying support structure 116. The flexible diffuser membrane 114 is secured to the underlying support structure 116 utilizing a proximal clamp 118 and a distal clamp 120.

Figure 3:
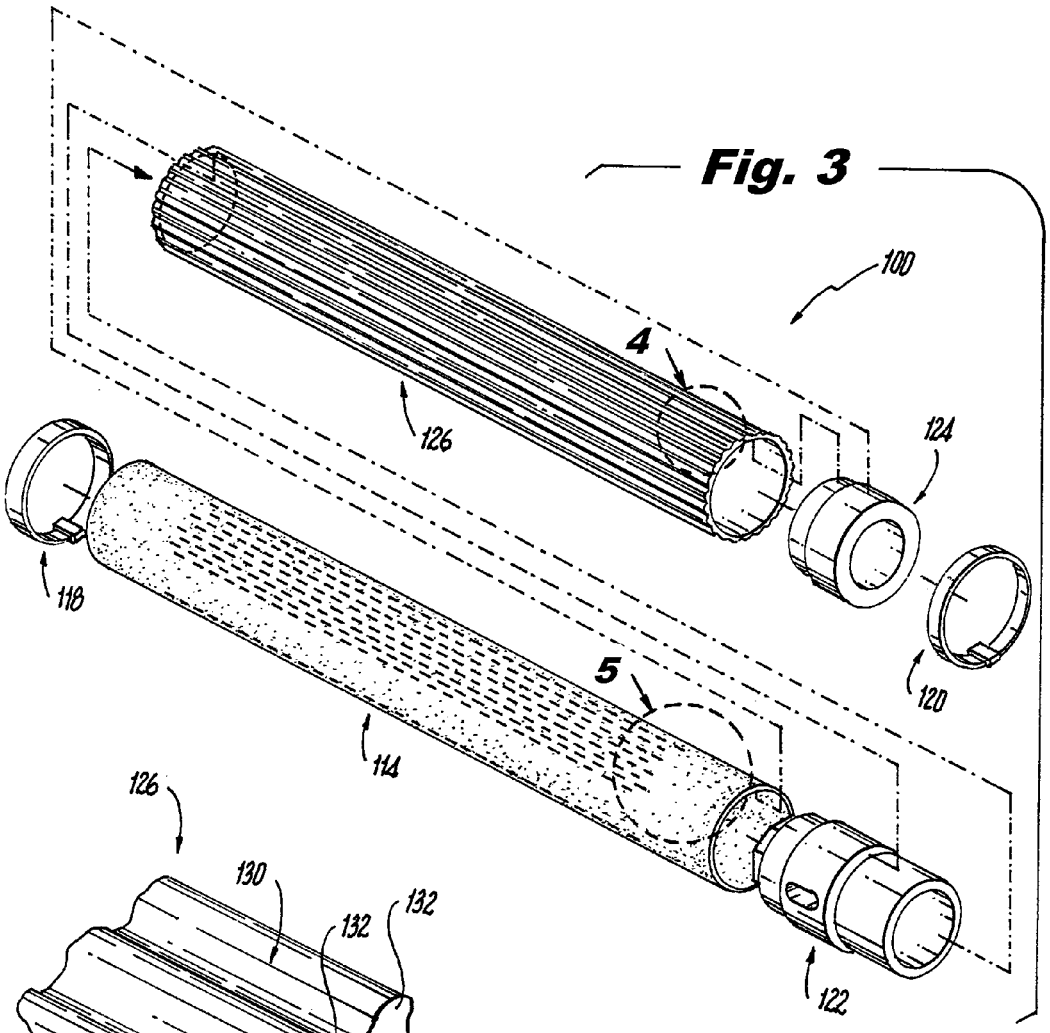
FIG. 3 shows an exploded perspective view of the tube diffuser in the FIG. 1 system.

Additional aspects of the representative tube diffuser 106 are shown in the exploded perspective view in FIG. 3. In addition to the flexible diffuser membrane 114 and the clamps 118, 120, the illustrative tube diffuser 106 further comprises a proximal end adapter 122, a distal end adapter 124, and a support tube 126. The support tube 126 is disposed between the proximal end adapter 122 and the distal end adapter 124. In so doing, the proximal end adapter 122, the distal end adapter 124, and the support tube 126 collectively form the support structure 116 for the flexible diffuser membrane 114. When assembled, as in FIG. 2, the flexible diffuser membrane 114 surrounds the support tube 126 as well as the majorities of the proximal end adapter 122 and the distal end adapter 124.

Figure 4:
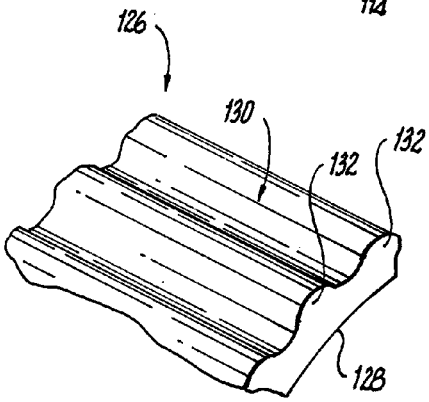
FIG. 4 shows a magnified perspective view of a portion of the support tube of the FIG. 3 tube diffuser.

In accordance with aspects of the invention, the support tube 126 comprises an inward facing surface 128 that is substantially cylindrical, and an outward facing surface 130 that defines a series of ridges 132 thereon. These ridges 132 are made more evident in FIG. 4, which shows a magnified perspective view of a representative portion of the support tube 126. In the present, non-limiting embodiment, the ridges 132 are substantially evenly spaced, and each of the ridges 132 defines a rounded profile. Moreover, in the present illustrative embodiment, the ridges 132 run substantially lengthwise along the support tube 126 and are positioned along its entire circumference. Nevertheless, it is emphasized that the particular shape and coverage pattern for the ridges 132 shown in FIGS. 3 and 4 are illustrative, and alternative shapes and distributions would also fall within the scope of the invention.

Figure 5:
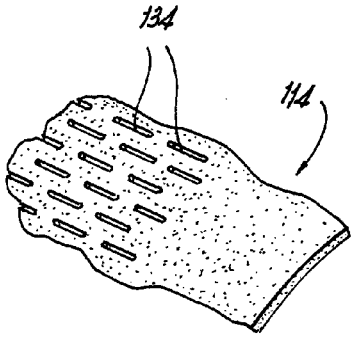
FIG. 5 shows a magnified perspective view of a portion of the diffuser membrane of the FIG. 3 tube diffuser.

While the support structure 116 is largely rigid, the flexible diffuser membrane 114 is preferably formed from an elastomeric material and is substantially flexible. Moreover, the flexible diffuser membrane 114 is patterned with a plurality of perforations 134. These perforations 134 are made more apparent in FIG. 5, which shows a magnified perspective view of a portion of the flexible diffuser membrane 114. The perforations 134 in the flexible diffuser membrane 114 allow the pressurized gas supplied by the square header pipe 104 to penetrate the flexible diffuser membrane 114 into the wastewater 102 in the form of fine bubbles. In the present illustrative embodiment, the perforations 134 are in the form of slits, but, in alternative embodiments, they may take on any one of several different shapes. In one or more alternative embodiments, for example, the perforations 134 may be round holes or star shapes rather than slits.

Figure 6:
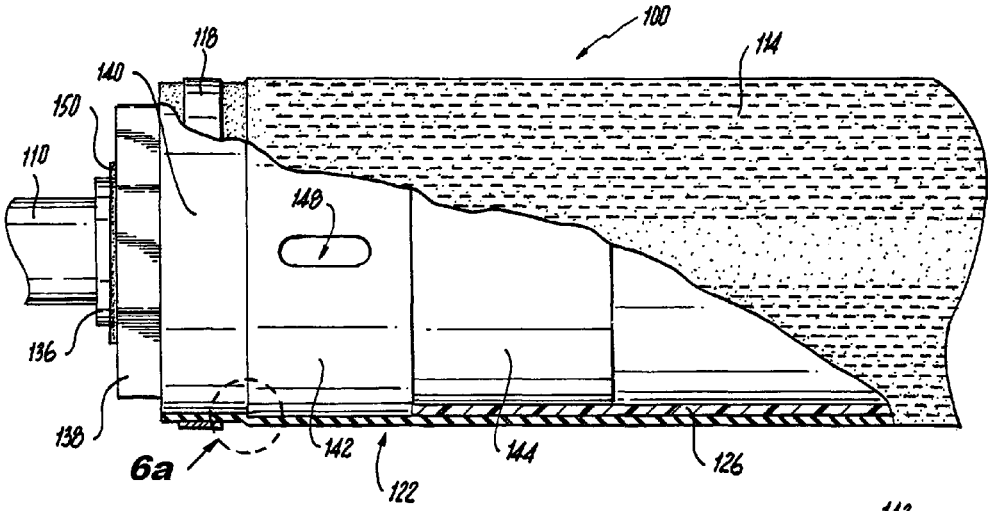
FIGS. 6-8 show partial sectional views of the proximal end adapter of the FIG. 3 tube diffuser.
Figure 6A:
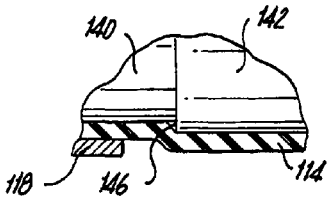
Figure 7:
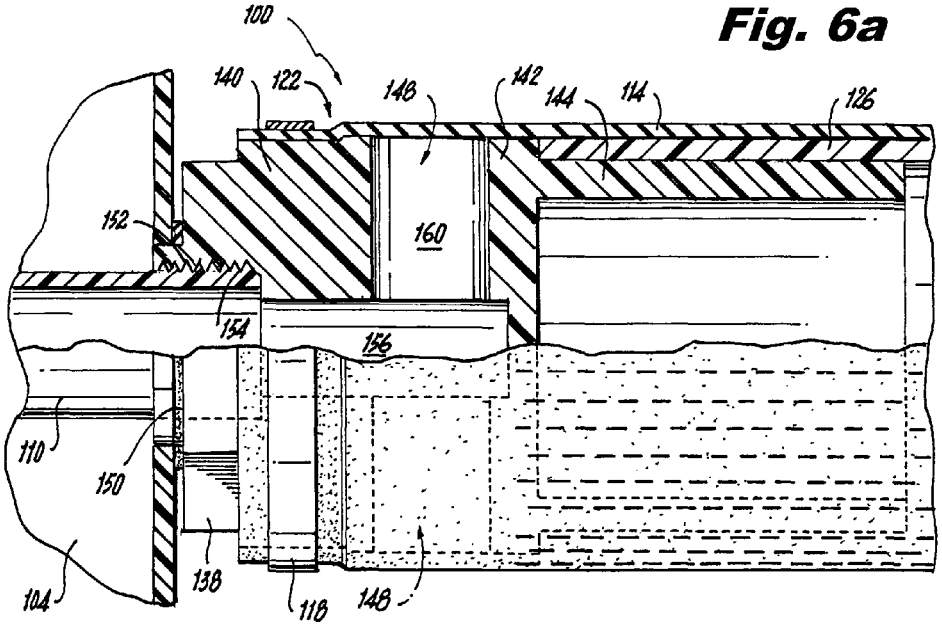
Figure 8:
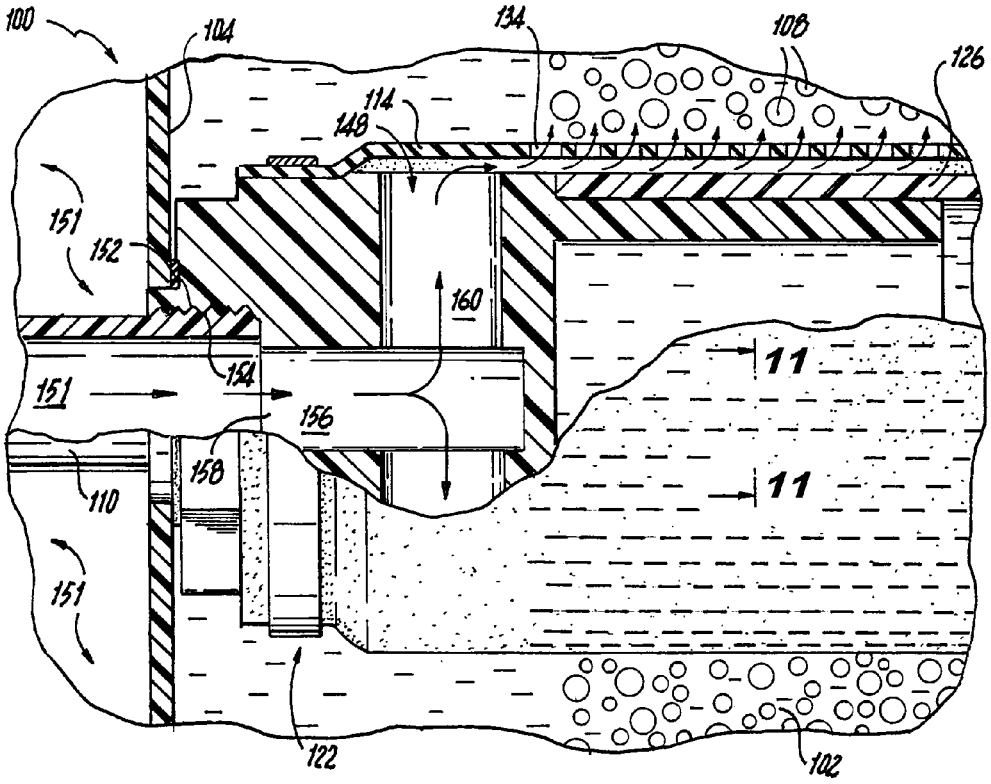

Additional details of the proximal end adapter 122 of the tube diffuser 106 are shown in the partial sectional views in FIGS. 6-8. Exterior features of the proximal end adapter 122 are, for example, most evident in FIGS. 6 and **6*a* (where FIG. 6*a* is a magnified region of FIG. 6). For purposes of illustration, the exterior of the proximal end adapter 122 can be conceptually separated into a coupling ring 136, an octagonal grasping portion 138, a proximal mounting portion 140, a proximal center portion 142, and a proximal connecting portion 144. Both the coupling ring 136 and the octagonal grasping portion 138 are directed at facilitating the coupling of the tube diffuser 106 to the square header pipe 104. More particularly, the coupling ring 136 acts as a means to support a rubber gasket 150, while the octagonal grasping portion 138 facilitates the applying of torqueing force to the tube diffuser 106 so that the tube diffuser 106 can be screwed onto the header pipe connector 110. During manufacture or in the field, the torqueing force may be readily applied to the octagonal grasping portion 138** utilizing a tool such as a wrench.

To the right of the octagonal grasping portion 138, the proximal mounting portion 140 provides a surface onto which to fixate an end of the flexible diffuser membrane 114 utilizing the proximal clamp 118. To aid in this fixation, the proximal mounting surface in the present illustrative embodiment defines a substantially cylindrical, smooth outer surface. Moreover, the proximal mounting portion 140 has an outer diameter slightly smaller than that of the adjacent proximal center portion 142. This difference in diameters creates a proximal raised lip 146 adjacent to the proximal mounting portion 140, easily seen in FIG. **6*a*. The proximal raised lip 146 is present to help inhibit the proximal clamp 118 from sliding longitudinally on the tube diffuser 106, that is, from left to right in FIG. 6**.

Still continuing to the right in FIG. 6, the proximal center portion 142 of the proximal end adapter 122 defines two gas outlet ports 148 therein that underlie the flexible tube diffuser 106 when the tube diffuser 106 is assembled (only one outlet port 148 being visible in FIG. 6). As will be described in greater detail below, these gas outlet ports 148 facilitate the supplying of the pressurized gas from the square header pipe 104 to a region between the proximal end adapter 122 and the flexible diffuser membrane 106. At the extreme right of the proximal end adapter 122, the proximal connecting portion 144, moreover, provides a substantially cylindrical outer surface upon which to mount the support tube 126. More particularly, in the present illustrative embodiment, the proximal connecting portion 144 defines an outer diameter about equal to the inner diameter of the support tube 126, thereby allowing an end of the support tube 126 to be slid over the proximal connecting portion 44. So placed, fixation between the proximal connecting portion 144 and the support tube 126 may be realized utilizing, for example, a fixation means such as an adhesive.

FIGS. 7 and 8 go on to show additional aspects of the interior regions of the proximal end adapter 122, and, in so doing, diagrammatically illustrate the manner in which the proximal end adapter 122 cooperates with the header pipe 104, the rubber gasket 150, and the header pipe connector 110 to cause the tube diffuser 106 to emit the bubbles 108 of gas into the surrounding wastewater 102. For illustrative purposes, FIG. 7 shows the square header pipe 104, the rubber gasket 150, the header pipe connector 110, and the tube diffuser 106 with the tube diffuser 106 at rest and not receiving pressurized gas. FIG. 8, in contrast, shows these same elements while the tube diffuser 106 is receiving a pressurized gas 151 from the square header pipe 104.

In the present illustrative embodiment, coupling between these various elements is achieved by screwing engaging threads 152 interior to the proximal end adapter 122 onto receiving threads 154 on the header pipe connector 110 using, for example, the octagonal grasping portion 138 and a suitable wrench to apply the required torqueing force. Coupling the two elements together in this manner has the effect of pulling the tube diffuser 106 towards the square header pipe 104 and ultimately compressing the rubber gasket 150 therebetween. Once the rubber gasket 150 is suitably compressed in this fashion, a gas-tight seal is formed between the tube diffuser 106 and the square header pipe 104.

At the same time, two internal channels within the proximal end adapter 122 are adapted to route pressurized gas received through the header pipe connector 110 to the two gas outlet ports 148 underlying the flexible diffuser membrane 114. More particularly, a longitudinal internal channel 156 in the proximal end adapter 122 sits adjacent to a distal end of the header pipe connector 110 and defines a gas inlet port 158 operative to receive the pressurized gas 151 from the header pipe connector 110 and carry it longitudinally a distance down the proximal end adapter 122 (left-to-right in FIGS. 7 and 8). The pressurized gas 151 is then released into a lateral internal channel 160, which carries the pressurized gas 151 laterally in the proximal end adapter 122 (up and down in FIGS. 7 and 8). The lateral internal channel 160 ultimately terminates in the two gas outlet ports 148.

Accordingly, as indicated in FIG. 8, the various above-described elements are adapted, in the present illustrative embodiment, such that the pressurized gas 151 from the square header pipe 104 is caused to flow from the square header pipe 104 into the header pipe connector 110, and through the gas inlet port 158 of the proximal end adapter 122. There the pressurized gas 151 continues to travel down the longitudinal internal channel 156 and the lateral internal channel 160 until it is ultimately expelled through the gas outlet ports 148 into a region between the proximal end adapter 122 and the flexible diffuser membrane 114. At that point, the pressurized gas 151 "inflates" the flexible diffuser membrane 114, causing the portion of the flexible diffuser membrane 114 between the proximal and distal clamps 118, 120 to stand somewhat displaced from the proximal end adapter 122, the support tube 126, and the distal end adapter 124. At the same time, the inflation of the flexible diffuser membrane 114 causes the perforations 134 to expand somewhat, and allows the underlying pressurized gas 151 to penetrate the flexible diffuser membrane 114 into the surrounding wastewater 102.

Figure 9:
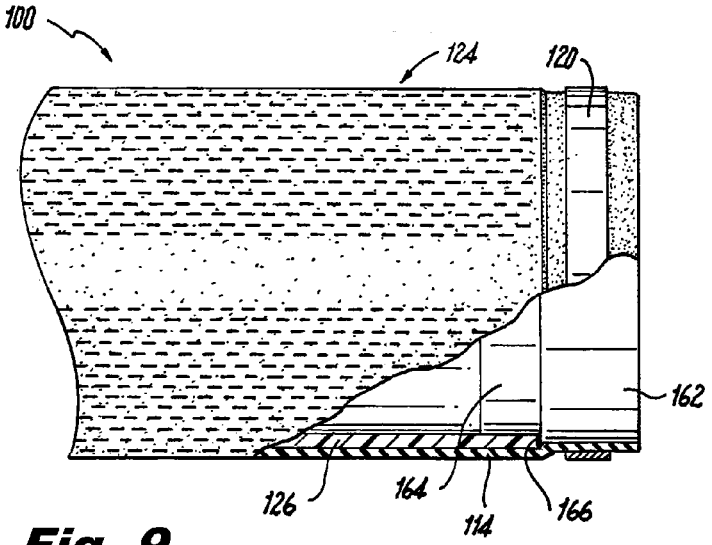
FIG. 9 shows a partial sectional view of the distal end adapter of the FIG. 3 tube diffuser.

For completeness, FIG. 9 shows a partial sectional view of the distal end adapter 124 of the tube diffuser 106. Like the proximal end adapter 122, the distal end adapter 124 in the present illustrative embodiment comprises a mounting portion, in this case, a distal mounting portion 162, which defines a substantially cylindrical, smooth outer surface so as to provide a good surface for clamping an end of the flexible diffuser membrane 114. What is more, the distal end adapter 124 also comprises a distal connecting portion 164 that defines a substantially cylindrical outer surface and is sized such that an end of the support tube 126 can be made to pass thereon and be fixated utilizing, for example, an adhesive. To again help prevent the distal clamp 120 from sliding longitudinally on the tube diffuser 106, the distal mounting portion 162 in the present embodiment has an outer diameter slightly smaller than that of the adjacent support tube 126 so that a distal raised lip 166 is formed adjacent to the distal mounting portion 162.

It will be noted that reference to FIG. 3 shows that, in the present non-limiting embodiment, the distal end adapter 124 defines a passage therethrough that allows wastewater 102 to pass through the distal end adapter 124 and fill a majority of the support tube 126 and, thereby, the majority of the tube diffuser 106. This "flooding" capability, although entirely optional, is deemed advantageous and is therefore preferred because it reduces the buoyancy of the tube diffuser 106. The reduced buoyancy places less stress on the wastewater aeration system 100 when immersed in the wastewater 102.

Advantageously, the above-described wastewater aeration system 100, and more generally, embodiments in accordance with aspects of the invention, may provide several advantages when compared to systems that utilize conventional elements. These advantages include the ability to place a flexible diffuser membrane 114 relatively tightly about the underlying support structure 116 without the attendant disadvantages of difficult installation, poor gas distribution uniformity, and increased head loss (see Background). At the same time, embodiments in accordance with aspects of the invention may suffer a significantly reduced number of flexure failures when compared to conventional systems.

Many of the above-identified advantages relate to the profile of the support tube 126, that is, the presence of the series of ridges 132. The effect of these ridges 132 is diagrammatically illustrated in FIGS. 10-12, which show sectional views of a portion of the tube diffuser 106 cleaved along the planes indicated in FIGS. 2 and 8. In these sectional views, relationships of the flexible diffuser membrane 114 relative to the support tube 126 are visible.

Figure 10:
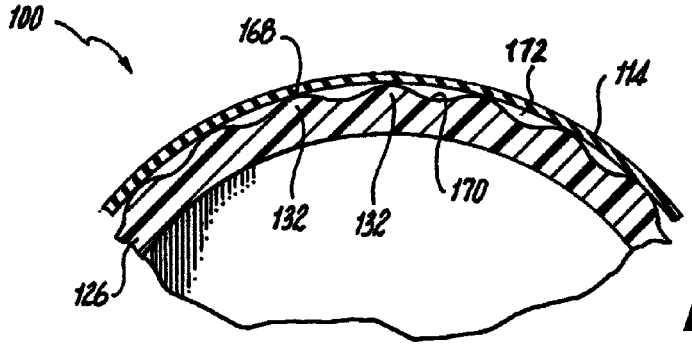
FIG. 10 shows a sectional view of a portion of the FIG. 3 tube diffuser without supplied pressurized gas while the tube diffuser is in air.

FIG. 10, for example, shows the illustrative tube diffuser 106 while the tube diffuser 106 is at rest in air (i.e., not immersed in the wastewater 102 and not being supplied with a pressurized gas). FIG. 10 may therefore depict a situation that would occur while the wastewater aeration system 100 is being installed or maintained. In this condition, the flexible diffuser membrane 114 contacts a respective radially outermost point 168 of each of the ridges 132, but does not contact a respective radially innermost point 170 of each of the ridges 132. This creates channels 172 between the two elements that run longitudinally down the support tube 126. Frictional contact between the flexible diffuser membrane 114 and the support tube 126 is thereby reduced, easing the manner in which the flexible diffuser membrane 114 may be slid over the support tube 126. Such a reduction in friction is particularly beneficial if the flexible diffuser membrane 114 is sized so as to be relatively tight around the support tube 126.

Figure 11:
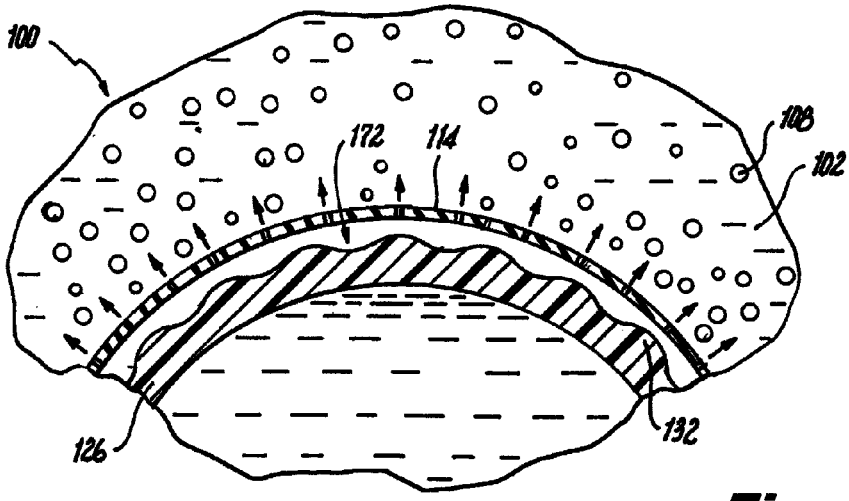
FIG. 11 shows a sectional view of a portion of the FIG. 3 tube diffuser with supplied pressurized gas while the tube diffuser is immersed.

FIG. 11, moreover, depicts a condition wherein the tube diffuser 106 is in an operational state, that is, immersed in the wastewater 102 and being supplied with pressurized gas. The tube diffuser 106 is therefore somewhat inflated and producing the bubbles 108. Here too, the channels 172 provided by the ridges 132 create beneficial effects. More particularly, the channels 172 help to distribute the pressurized gas longitudinally down the support tube 126, increasing the uniformity of the gas distribution across the support tube 126. Fouling of the flexible diffuser membrane's perforations 134, when it does occur, also occurs more uniformly along the flexible diffuser membrane 114, further enhancing gas distribution uniformity. With the improved gas distribution uniformity, bubble formation is made more even across the flexible diffuser membrane 114. At the same time, the channels 172 also reduce the head loss associated with inflating and penetrating the diffuser membrane.

Figure 12:
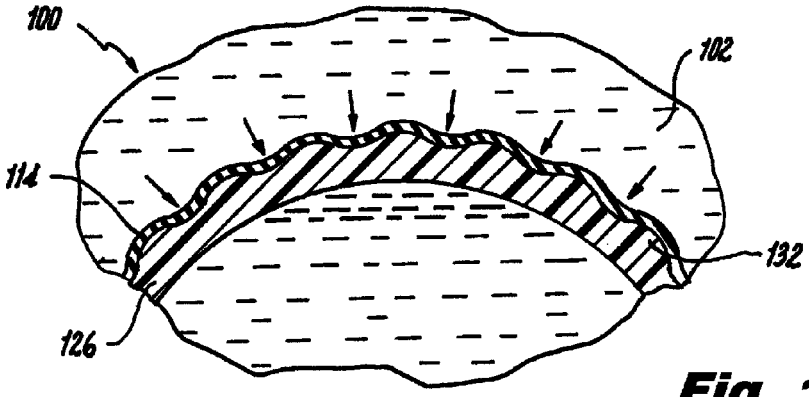
FIG. 12 shows a sectional view of a portion of the FIG. 3 tube diffuser without supplied pressurized gas while the tube diffuser is immersed.

Finally, FIG. 12 shows a condition wherein the tube diffuser 106 is immersed in wastewater 102 and the pressurized gas is turned off As indicated in the figure, because of the external pressure on the flexible diffuser membrane 114 created by the wastewater 102, the flexible diffuser membrane 114 conforms to the undulations in the ridges 132. In spreading across the ridges 132 in this manner, the flexible diffuser membrane 114 is prevented from bunching up or pinching off. That is, the ridges 132 supply the flexible diffuser membrane 114 with a large, gently-shaped surface area onto which to relax when the pressurized gas is turned off Flexure failures of the type described above are thereby avoided about the entire circumference of the support tube 126.

Figure 14:
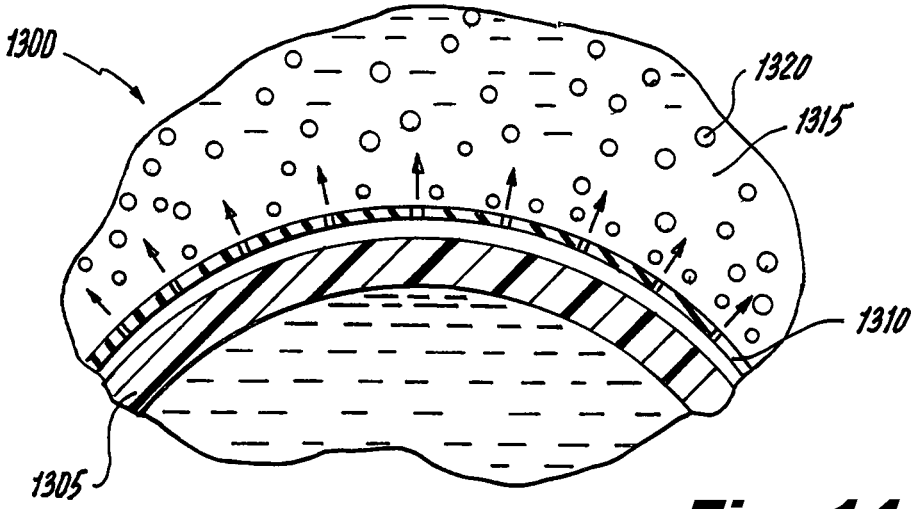
FIG. 14 shows a sectional view of a portion of the FIG. 13 tube diffuser with supplied pressurized gas while the tube diffuser is immersed.
Figure 15:
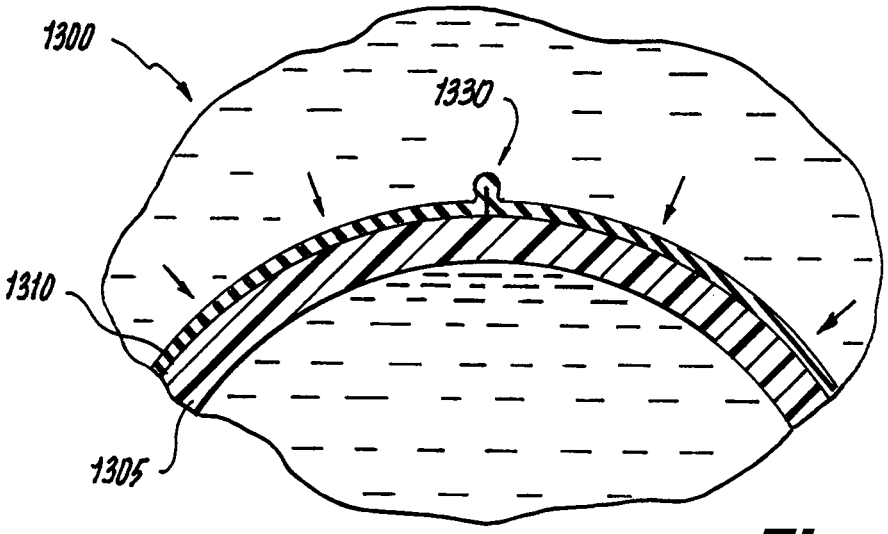
FIG. 15 shows a sectional view of a portion of the FIG. 13 tube diffuser without supplied pressurized gas while the tube diffuser is immersed.

The above-identified beneficial effects of the ridges 132 in the support tube 126 may be further elucidated by describing the dynamics of a tube diffuser without the ridges. Accordingly, for comparison purposes, FIGS. 13-15 show sectional views through the center of an alternative tube diffuser 1300 comprising a support tube 1305 and a flexible diffuser membrane 1310, wherein the support tube 1305 defines an outermost surface that is smooth (i.e., devoid of ridges).

Figure 13:
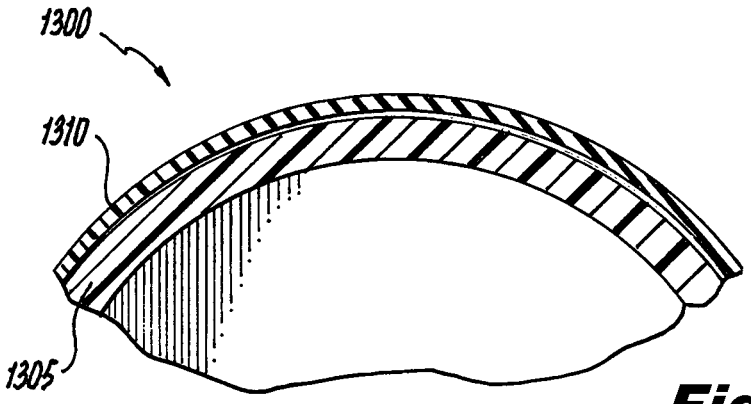
FIG. 13 shows a sectional view of a portion of a tube diffuser with a smooth support tube without supplied pressurized gas while the tube diffuser is in air.

While the alternative tube diffuser 1300 is at rest in air, as shown in FIG. 13, the flexible diffuser membrane 1310 is in full contact with the underlying support tube 1305. As a result, any significant tightness of the flexible diffuser membrane 1310 relative to the support tube 1305 creates substantial friction, which may interfere with ease of installation of the flexible diffuser membrane 1310 onto the support tube 1305. At the same time, with the tube diffuser 1300 immersed in wastewater 1315 and supplied with pressurized gas so as to emit bubbles 1320, as indicated in FIG. 14, gas distribution uniformity, particularly longitudinally down the support tube 1305, may be poor because of the limited space between the inflated flexible diffuser membrane 1310 and the support tube 1305, again, particularly if the flexible diffuser membrane 1310 is relatively tight around the support tube 1305. Finally, with the tube diffuser 1300 immersed but the supply of pressurized gas turned off, as depicted in FIG. 15, the flexible diffuser membrane 1310 may have a tendency to fold on itself, as depicted by a fold 1330 in the figure. Repeated folding of this type places stress on the flexible diffuser membrane 1310 and may ultimately causes flexure failures. While shown at the crown of the tube diffuser 1300 in FIG. 15 (i.e., the highest point of the tube diffuser 1300), in actual practice, these kinds of folds can occur anywhere about the circumference of the tube diffuser 1300 because of currents in the wastewater 1315 as well as debris (e.g., rags) that may wrap around the tube diffuser 1300.

Advantageously, once understood given the teachings herein, the elements of the tube diffuser 106 may be fabricated from conventional materials utilizing conventional fabrication techniques. These materials and techniques will be familiar to one having ordinary skill in the fabrication arts. The adapters 122, 124 and the tube support 126, may, for example, be made from a plastic or a metal. These parts may be variously extruded, cast, or molded. The flexible diffuser membrane 114 may also be made utilizing several different materials including, but not limited to, ethylene-propylene-diene-monomer (EPDM) rubber, polyurethane rubber, silicone rubber, and nitrile butadiene rubber. Compression molding is presently the preferred manufacturing technique for flexible diffuser membranes, although other manufacturing techniques (e.g., injection molding) would also come within the scope of the invention. Once released from a mold, a flexible diffuser membrane is preferably perforated with needles or knives, as desired.

It should again be emphasized that the above-described embodiments of the invention are intended to be illustrative only. Other embodiments can use different types and arrangements of elements for implementing the described functionality. These numerous alternative embodiments within the scope of the appended claims will be apparent to one skilled in the art.

A tube diffuser falling within the scope of the invention may, for example, be attached to a header pipe in a manner very different from that set forth above. In one or more embodiments, a tube diffuser falling within the scope of the invention may, for instance, be coupled to a round header pipe utilizing a saddle-type connector or the like.

Figure 16:
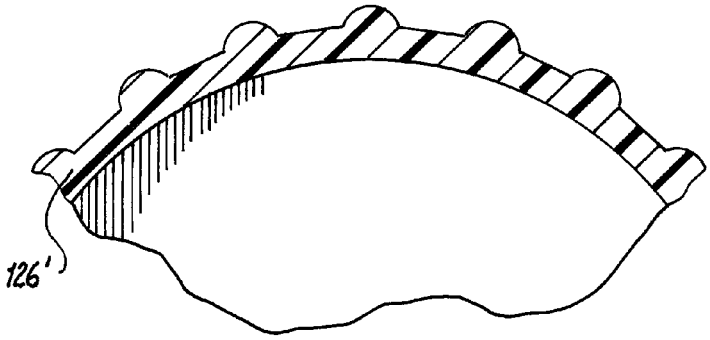
FIGS. 16 and 17 show sectional views of portions of support tubes with alternative ridge profiles in accordance with illustrative embodiments of the invention.
Figure 17:
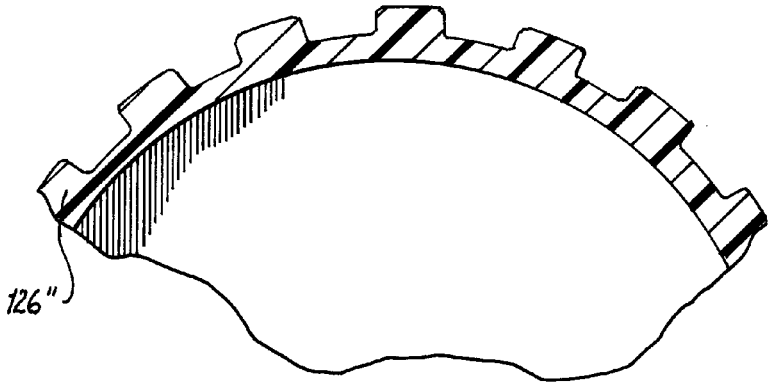

As even another example, tube diffusers falling within the scope of the invention may utilize support tubes with ridge profiles very different from that shown in FIGS. 3, 4, and 10-12. In the above-described embodiment, the support tube 126 comprises ridges 132 with wave-shaped profiles. FIGS. 16 and 17, in contrast, show sectional views of portions of a first alternative support tube 126' and a second alternative support tube 126", respectively, having ridges with very different profiles. In FIG. 16, the support tube 126' includes a series of ridges that are rounded off at their tops and squared off at their bottoms. In FIG. 17, the support tube 126" includes a series of ridges that are squared-off at their tops and bottoms. In even one or more embodiments, ridges may even have circular profiles. Moreover, ridges, in one or more embodiments, whatever their particular shape, may be formed separately from the remainder of a support tube, and then subsequently adhered to the remainder of the support tube in a following step utilizing, for example, an adhesive. That is, the series of ridges need not necessarily be formed at the same time as the remainder of their corresponding support tube.

Figure 18:
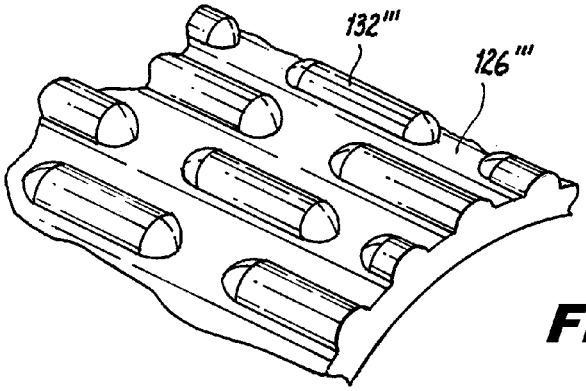
FIG. 18 shows a perspective view of a portion of a support tube with an alternative ridge design in accordance with an illustrative embodiment of the invention.

In addition, in the previous embodiments, the support tubes 126, 126', 126" define stripes of ridges that, independent of their respective profiles, are substantially continuous in the longitudinal direction of the support tubes 126, 126', 126" and are arranged circumferentially about their support tubes 126, 126', 126". In even one or more embodiments, however, a given longitudinal ridge stripe may comprise alternating ridges and valleys, thereby creating a series of ridges that are arranged longitudinally along a support tube. Such a design is shown in FIG. 18, which shows a perspective view of a portion of a support tube 126''' with ridges 132'''. This design and those like it would also fall within the scope of the invention.

Moreover, all the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

Any element in a claim that does not explicitly state "means for" performing a specified function or "step for" performing a specified function is not to be interpreted as a "means for" or "step for" clause as specified in 35 U.S.C. §112, ¶6. In particular, the use of "step of" in the claims herein is not intended to invoke the provisions of 35 U.S.C. §112, ¶6.

What is claimed is:

1. An apparatus comprising:

a proximal end adapter;

a distal end adapter;

a support tube, the support tube spanning between the proximal end adapter and the distal end adapter, and defining an inward facing surface that is round cylindrical, and an outward facing surface that defines a series of ridges thereon; and a flexible diffuser membrane, the flexible diffuser membrane defining a plurality of perforations therein, and surrounding at least a respective portion of each of the proximal end adapter, the distal end adapter, and the support tube;

wherein two diametrically opposed regions of the flexible diffuser membrane include perforations;

wherein the proximal end adapter defines a proximal mounting portion onto which an end of the flexible diffuser membrane is disposed;

wherein the end of the flexible diffuser membrane surrounds the proximal mounting portion and is fixated to the proximal mounting portion utilizing a clamp;

wherein the proximal end adapter defines a proximal connecting portion onto which the support tube is mounted;

wherein the proximal connecting portion defines a round cylindrical outer surface, at least a portion of which underlies a portion of the support tube;

wherein the distal end adapter defines a distal connecting portion with a distal round cylindrical outer surface underlying a portion of the support tube and onto which the support tube is mounted.

2. The apparatus of claim 1, wherein the proximal mounting portion defines a round cylindrical outer surface.

3. The apparatus of claim 1, wherein the apparatus defines a raised lip adjacent to the proximal mounting portion.

4. The apparatus of claim 1, wherein the proximal end adapter comprises a gas inlet port in gaseous communication with one or more gas outlet ports, the one or more gas outlet ports underlying the flexible diffuser membrane.

5. The apparatus of claim 1, wherein the distal end adapter defines a distal mounting portion onto which an end of the flexible diffuser membrane is disposed.

6. The apparatus of claim 5, wherein the end of the flexible diffuser membrane is fixated to the distal mounting portion utilizing a clamp.

7. The apparatus of claim 5, wherein the distal mounting portion defines a round cylindrical outer surface.

8. The apparatus of claim 5, wherein the apparatus defines a raised lip adjacent to the distal mounting portion.

9. The apparatus of claim 1, wherein each ridge of the series of ridges runs lengthwise along the support tube.

10. The apparatus of claim 1, wherein the series of ridges are arranged circumferentially about the support tube.

11. The apparatus of claim 1, wherein the series of ridges are arranged longitudinally along the support tube.

12. The apparatus of claim 1, wherein the series of ridges are evenly spaced.

13. The apparatus of claim 1, wherein a respective portion of each ridge of the series of ridges defines a rounded profile.

14. The apparatus of claim 1, wherein the series of ridges describe a wave-shaped profile.

15. The apparatus of claim 1, wherein a ridge of the series of ridges defines a radially outermost point and a radially innermost point, and the flexible diffuser membrane contacts the radially outermost point but does not contact the radially innermost point when the apparatus is at rest in air.

16. The apparatus of claim 1, wherein the apparatus is immersed in a liquid.

17. The apparatus of claim 16, wherein the proximal end adapter is supplied with a pressurized gas.

18. The apparatus of claim 17, wherein at least a portion of the pressurized gas is released into the liquid through at least a portion of the plurality of perforations.

* * * * *